US007624730B2

(12) United States Patent
Dang

(10) Patent No.: US 7,624,730 B2
(45) Date of Patent: Dec. 1, 2009

(54) ADJUSTABLE QUICK INSTALL/REMOVE STOVE GUARD

(75) Inventor: Qi Dang, 32964 Soquel St., Union City, CA (US) 94587

(73) Assignee: Qi Dang, Union City, CA (US)

( * ) Notice: Subject to any disclaimer, the term of this patent is extended or adjusted under 35 U.S.C. 154(b) by 545 days.

(21) Appl. No.: 11/650,881

(22) Filed: Jan. 6, 2007

(65) Prior Publication Data

US 2008/0163859 A1 Jul. 10, 2008

(51) Int. Cl.
*F24C 3/12* (2006.01)
*F24C 15/12* (2006.01)

(52) U.S. Cl. ..... 126/42; 126/214 D; 126/201

(58) Field of Classification Search ..... 126/42, 126/211

See application file for complete search history.

(56) References Cited

U.S. PATENT DOCUMENTS 4,157,705 A 6/1979 Caan
4,517,955 A 5/1985 Ehrlich et al.
4,836,181 A 6/1989 Saga
5,546,928 A 8/1996 Lewis
5,664,554 A * 9/1997 Martin ..... 126/201
5,758,636 A 6/1998 Butrimas
5,842,464 A 12/1998 Koch
2005/0279348 A1 * 12/2005 Cheng ..... 126/638

* cited by examiner

*Primary Examiner*—Steven B McAllister
*Assistant Examiner*—Sarah Suereth

(57) ABSTRACT

A stove (or range) burner guard attached to the front of a gas or electrical stove (or range) by inserting the adjustable guard panel supports between the oven door handle and the oven door. The guard panel supports are secured to the oven by two identical holding devices, which are attached to the surface of the oven door. The guard prevents young children from reaching the burners, control knobs and cookware on the stovetop. The guard can be installed or removed in seconds.

2 Claims, 6 Drawing Sheets

ADJUSTABLE QUICK INSTALL/REMOVE STOVE GUARD

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

1. Field of Invention

The invention is related to an adjustable stove burner guard, which prevents small children from reaching the burners, control knobs and cookware on the stovetop. The guard also prevents small children from coming in contact with heated liquid or other foods that may bubble or splash from cookware on the stovetop. The guard is adjustable to fit stoves of different widths and designs and can be installed or removed in seconds.

2. Description of the Prior Art

A patent application was filed by the present inventor for a quick install/remove stove guard. The guard panel in the previous design consists of a one-piece sheet of material, and the width of the lower portion of the panel is reduced to fit the door handle of the oven door. The width of the lower portion of the guard panel can not be changed once the panel is made. This creates the possibility that the panel will not fit within some oven door handles, limiting the application of that stove guard design to certain types of the stoves. The new design solves this problem by using two adjustable guard panel supports to support the guard panel. The distance between the two guard panel supports can be adjusted to fit nearly all ovens with an elongated C-shape oven door handle.

Other stove guards were invented in the prior art to prevent small children from reaching the stove burners, control knobs and cookware while cooking as listed on the following list:

| | | |
|---|---|---|
| 4,157,705 | June 1979 | Caan |
| 4,517,955 | May 1985 | Ehrlich et al. |
| 4,836,181 | June 1989 | Saga |
| 5,546,928 | August 1996 | Lewis et al. |
| 5,758,636 | June 1998 | Butrimas et al. |
| 5,842,464 | December 1998 | Koch |

Those devices described in the prior art often require complicated installation procedures. Once installed, the devices are difficult to remove for cleaning. In some cases, the guard panels are attached to the top of the stove surface, making the guard panel vulnerable to heat damage.

The complicated installing and removing devices make those guards less likely to be used on a regular basis when small children are present, and this departs from the purpose of the inventions. Therefore, new and improved stove guards are needed to overcome the disadvantages of the existing inventions. The current invention addresses this need.

SUMMARY OF THE INVENTION

The objective of this invention is to provide a reliable, and simple way to install a stove guard on most ovens to prevent small children from reaching the stove burners, control knobs and cookware while cooking. The present invention provides an adjustable stove guard that requires no permanent mounting device, and can be installed or removed in seconds, which increases the likelihood that parents and other caregivers of small children will use it more frequently. The two adjustable guard panel supports are inserted between the oven door handle and the oven door, and secured by two identical holding devices attached to the surface of the oven door. The guard panel is connected to the guard panel supports, and extends outward and upward from the stove.

The guard panel is not attached to the top surface of the stove where the burners are located, thus minimizing the chance that heat damage to the guard panel will occur during use. When installed, the lower portion of the stove guard panel extends about 25 degrees outward from the surface of the oven door to provide more room for cookware handles and utensils. The upper portion of the guard panel is bent upward about 25 degrees to be approximately parallel with the surface of the oven door to increase the rigidity of the guard panel.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DESCRIPTION OF THE PREFERRED EMBODIMENT

Figure 1:
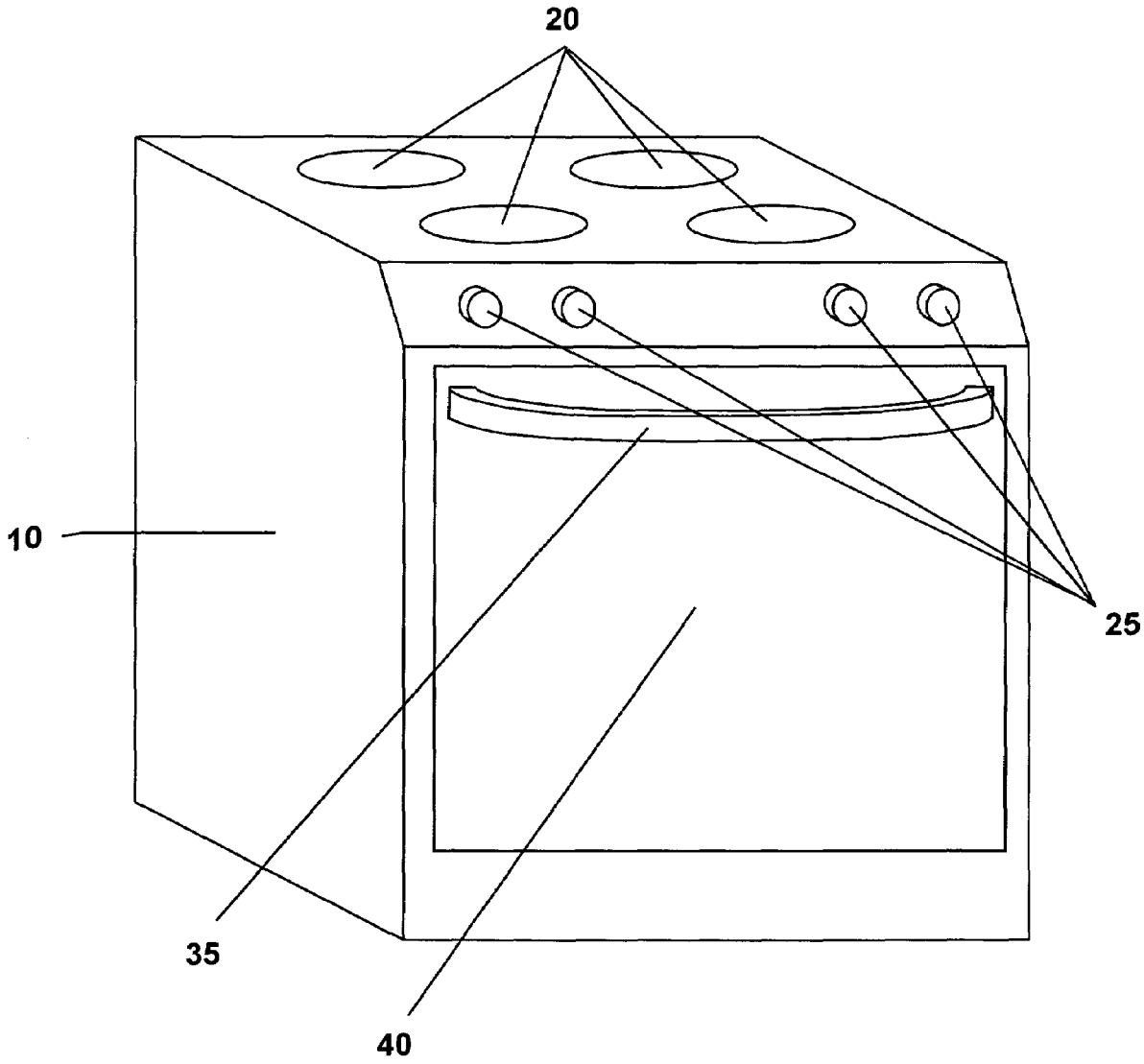
FIG. 1 is a view of a stove/range with burners on the top and an oven with the door handle located beneath the burners. Control knobs are located in the upper front of the range.

The invention provides a new and improved design of an adjustable quick install/remove stove guard. For the purposes of promoting an understanding of the principles of the invention, reference will now be made to the embodiments illustrated in the drawings referred to as FIGS. 1 to 9.

FIG. 1 is a view of a typical range 10. Burners 20 are located on the top of the range 10. Control knobs 25 are located in the upper front of the range. The oven is located beneath the burner top. A hinged oven door 40 is located in the front of the oven. An elongated C-shaped oven door handle 35 is attached to the upper portion of the oven door.

Figure 2:
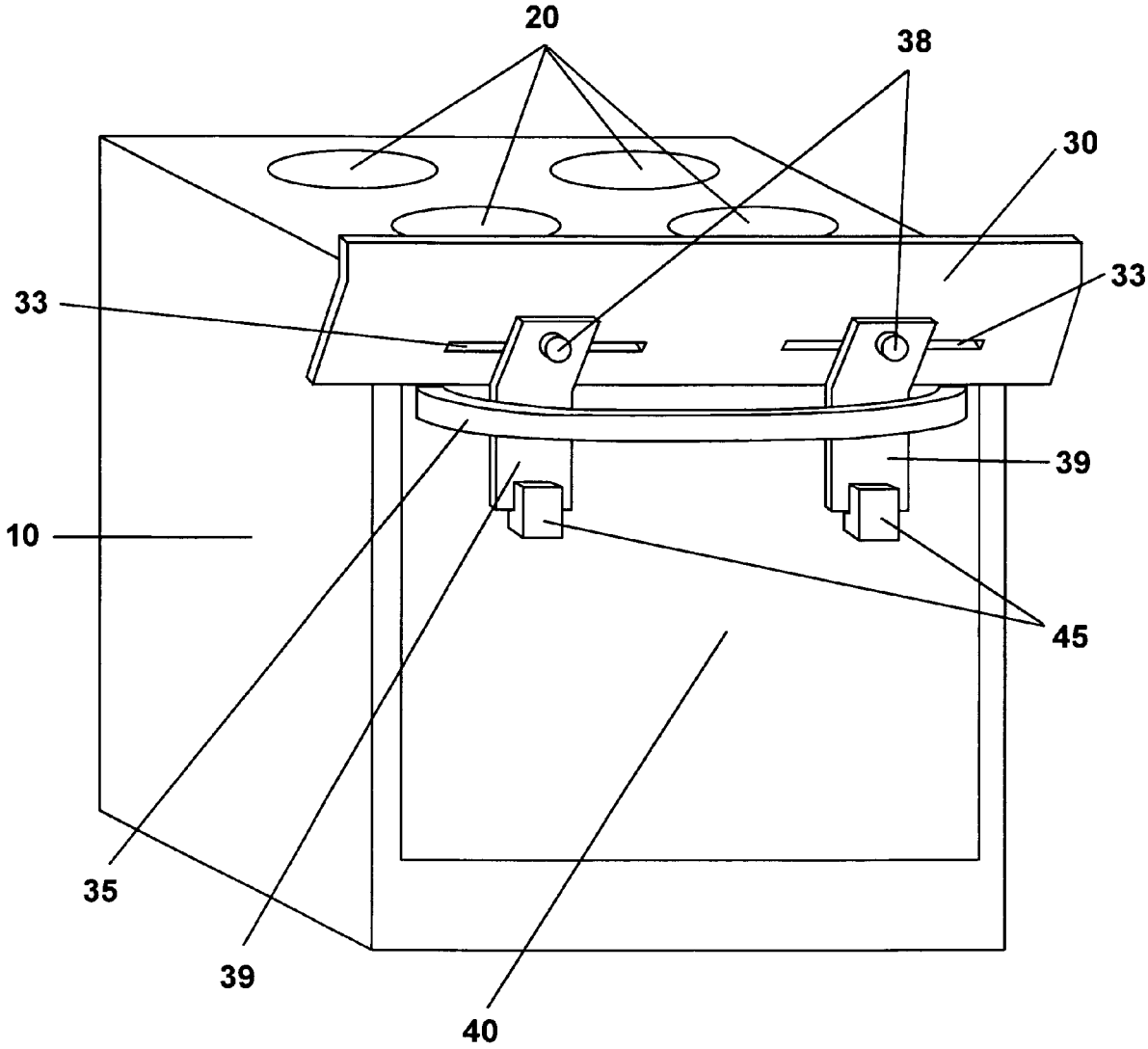
FIG. 2 is the perspective view of the range with the stove guard installed in a secured position.

FIG. 2 is the perspective view of the range with the stove guard panel 30 supported by two identical adjustable guard panel supports 39 that are connected to the guard panel by two bolts 38 through horizontal slots 33. The distance between the guard panel supports 39 can be adjusted by sliding the bolts 38 in the slots 33 to fit the width of the oven door handle 35. Once the guard panel supports 39 are positioned, the bolts 38 are tightened. The two guard panel supports 39 are inserted between the oven door handle 35 and the oven door 40. The bottom edges of the adjustable guard panel supports 39 are secured by insertion into the deep groove 47 (see FIG. 7) on the upper portion of each holding device 45.

Figure 3:
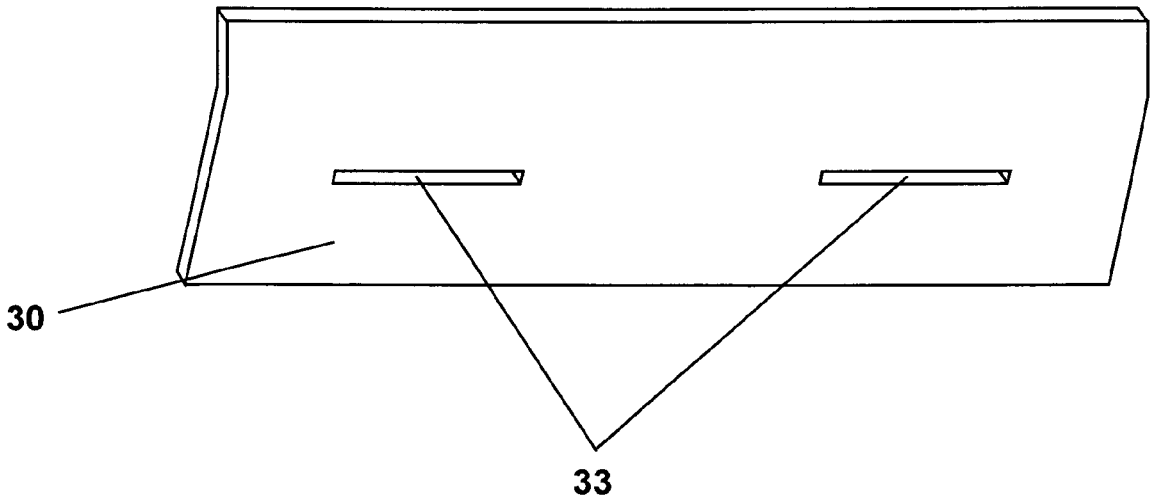
FIG. 3 is the front view of the guard panel. Two penetrating horizontal slots are made in the middle portion of the panel.

FIG. 3 is the front view of the guard panel 30. The upper portion of the panel 30 is bent so that when installed, this portion of the guard panel is nearly vertical. This increases the rigidity of the guard panel. Two identical horizontal penetrating slots 33 are made in the middle portion of the guard panel 30.

Figure 4:
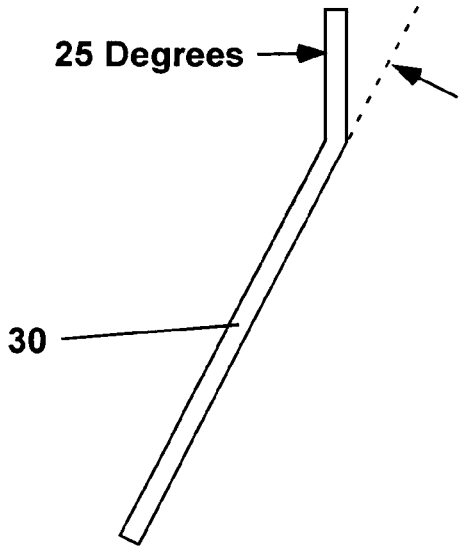
FIG. 4 is the side view of the guard panel. The upper portion of the panel is bent by about 25 degrees.

FIG. 4 is the side view of the guard panel 30. The upper portion of the panel 30 is bent by about 25 degrees so that when installed, this portion of the guard panel is nearly vertical. This increases the rigidity of the guard panel.

Figure 5:
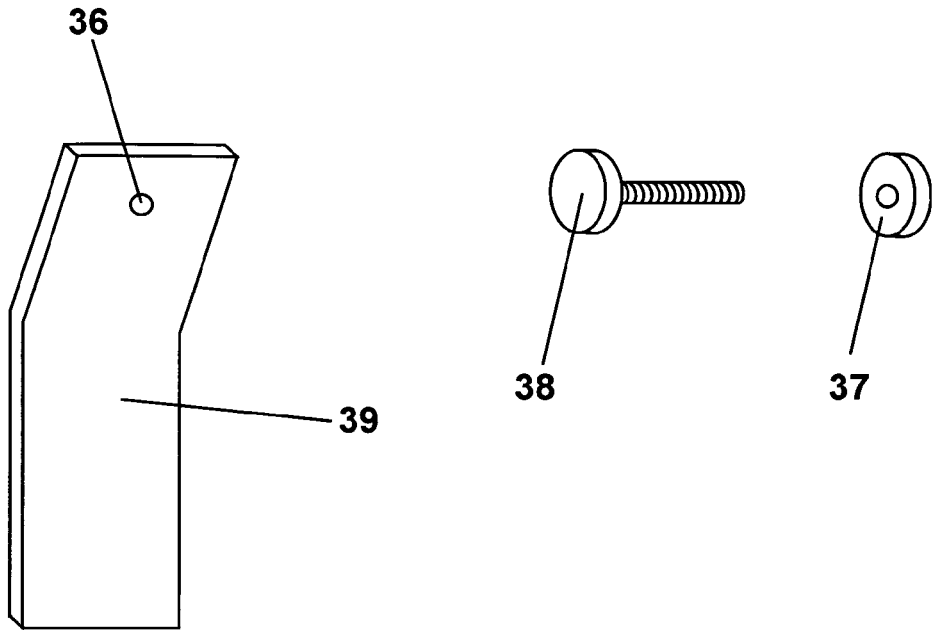
FIG. 5 is the view of one of the two identical guard panel supports. A round penetrating hole is drilled on the upper portion of the panel support. The diameter of the hole is slightly larger than the diameter of the bolt. A flat head bolt and a corresponding fastening knob with threaded insert are also shown.

FIG. 5 is the view of one of the two identical guard panel supports 39. A round penetrating hole 36 is drilled on the upper portion of the panel support 39. The diameter of the hole 36 is slightly larger than the diameter of the bolt 38. A flat head bolt 38 and a corresponding fasting knob 37 with threaded insert are also shown.

Figure 6:
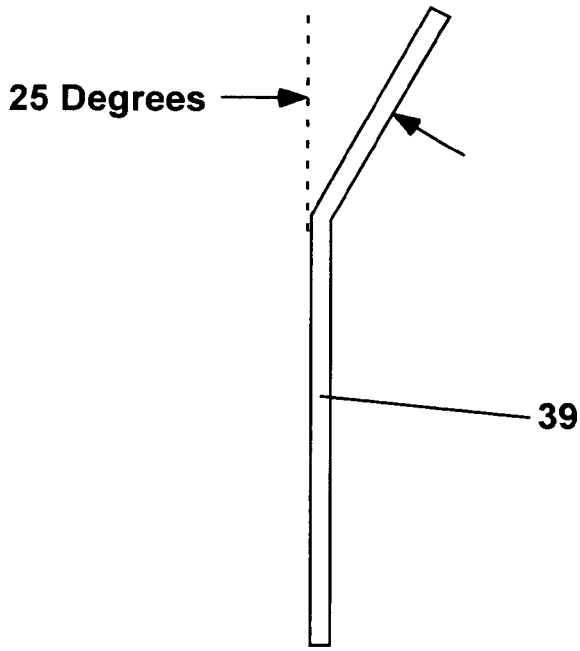
FIG. 6 is the side view of one of the two identical guard panel supports. The upper portion is bent by about 25 degrees.

FIG. 6 is the side view of one of the two identical guard panel supports 39. The upper portion is bent outward by about 25 degrees to provide extra space for cookware handles and to reduce the chance that the guard panel will be damaged by heat.

Figure 7:
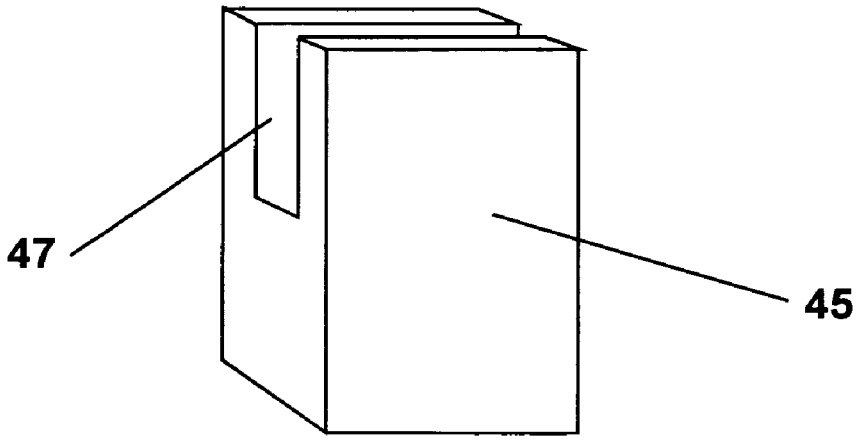
FIG. 7 is the view of one of the two identical holding devices.

FIG. 7 is the view of one of the two identical holding devices 45. Each device 45 is a rectangular block with a deep groove 47 cut on the upper portion of the device. The width of the groove 47 is slightly greater than the thickness of the guard panel supports 39.

Figure 8:
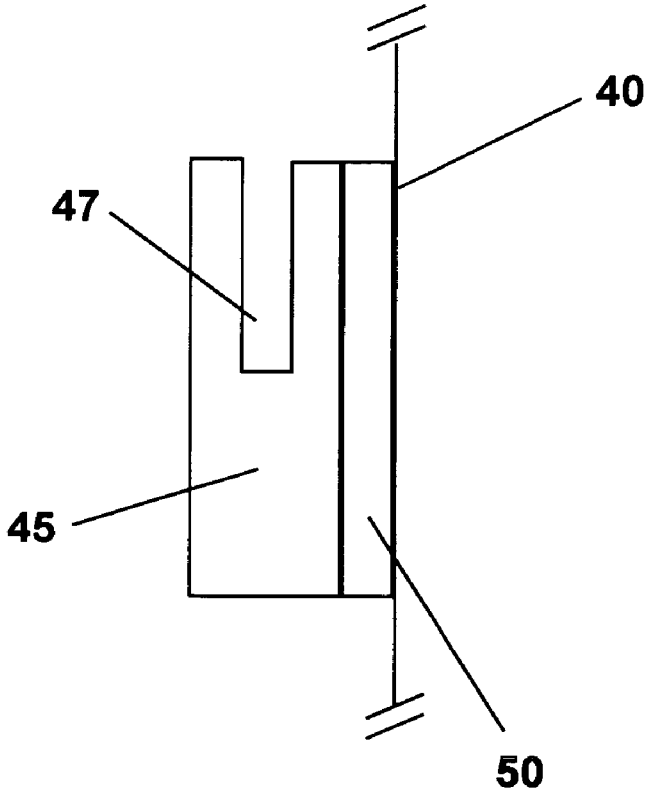
FIG. 8 is the cross section view of one of the two identical holding devices, which are attached by double-faced tape to the outer surface of the oven door. Each holding device is made of a rectangular block with a deep groove cut on the upper portion of the block.

FIG. 8 is the cross section view of one of the two identical holding devices 45 when it is attached to the surface of the oven door 40 by double-faced tape 50, showing the deep groove 47 cut on the upper portion of the device.

Figure 9:
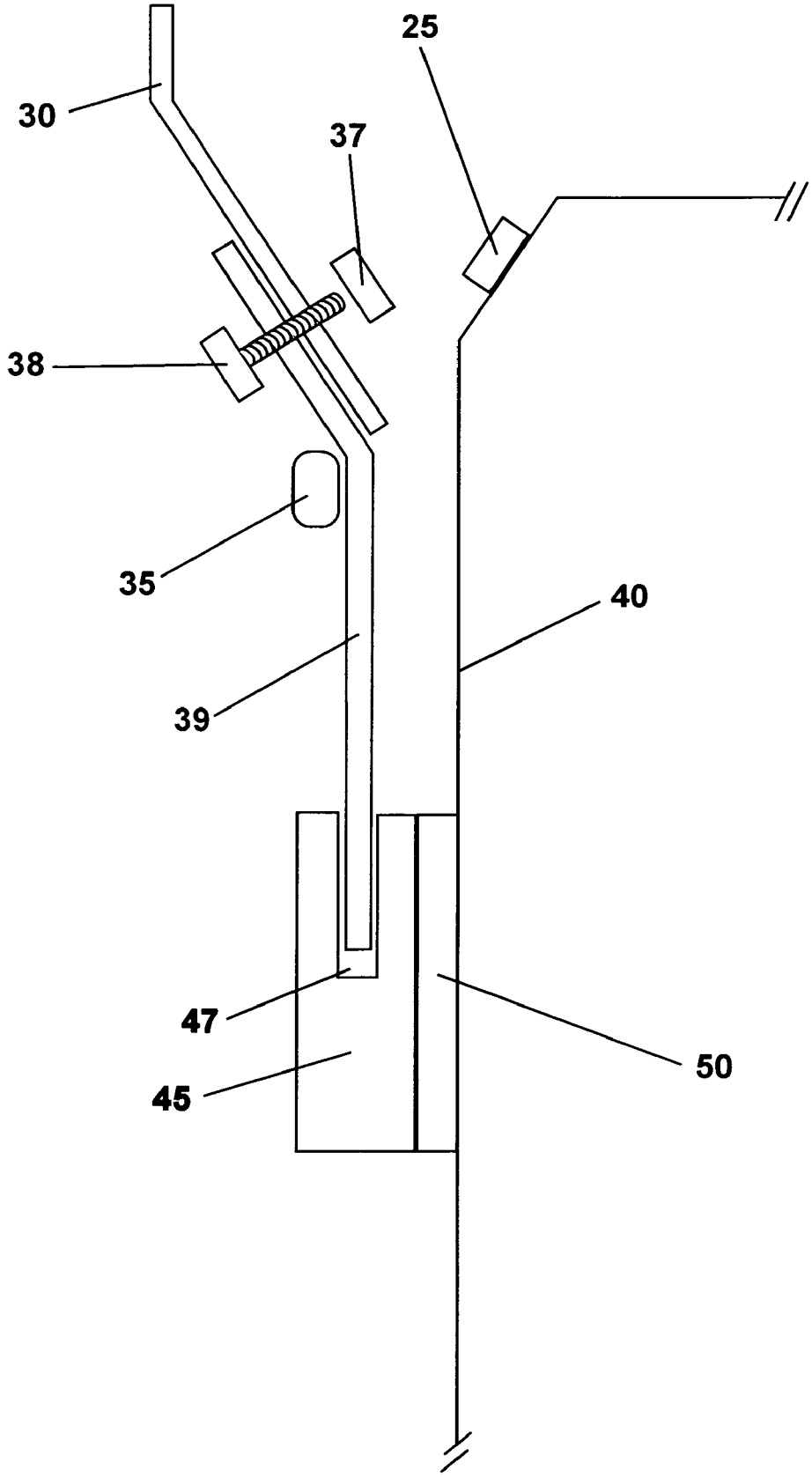
FIG. 9 is the cross section view of the installed guard panel. The bottom edge of each guard panel support is inserted into the groove cut into the upper portion of each holding device.

FIG. 9 is the cross section view of the installed stove guard. The guard panel support 39 is bolted onto the guard panel 30 by fasteners 37 and 38. Each adjustable guard panel support 39 is inserted into the groove 47 on the upper portion of the holding device 45. When the bottom edge of each adjustable guard panel support 39 is inserted into the holding device 45, the guard panel 30 is secured, and cannot rock back and forth.

The guard panel 30, adjustable guard panel supports 39 and holding devices 45 can be made of plastic, aluminum, other metals or other durable materials.

What are claimed:

1. A stove guard assembly comprising: a guard panel mounted on an oven door of a stove, said guard panel including an upper rectangular portion and a lower rectangular portion, said upper and lower rectangular portions having a width greater than a width of the stove, said lower rectangular portion being inclined outwardly and having a bottom edge resting on a handle of said oven door, said upper rectangular portion being parallel to said oven door; said lower rectangular portion adjustably attached to two guard panel supports wherein said guard panel supports are inserted between said oven door handle and said oven door; further comprising two U-shaped holding devices mounted on a front surface of said oven door, said U-shaped holding devices each receiving a bottom edge of said guard panel supports.

2. The stove guard assembly of claim 1, wherein said lower rectangular portion is adjustably attached to said guard panel supports by two slots in said lower rectangular portion each receiving a bolt extending through one of said guard panel supports.

* * * * *